US011253112B1

(12) United States Patent
Bickford et al.

(10) Patent No.: US 11,253,112 B1
(45) Date of Patent: Feb. 22, 2022

(54) REFILLABLE CYLINDRICAL COSMETIC WIPE DISPENSING SYSTEM

(71) Applicant: L'Oreal, Paris (FR)

(72) Inventors: William R. Bickford, Scotch Plains, NJ (US); Gloriana Redondo, Jersey City, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 17/025,648

(22) Filed: Sep. 18, 2020

(51) Int. Cl.

| | |
|---|---|
| ***A47K 10/38*** | (2006.01) |
| ***B65D 83/08*** | (2006.01) |
| ***B65D 85/672*** | (2006.01) |
| *A47K 10/32* | (2006.01) |

(52) U.S. Cl.
CPC ..... *A47K 10/38* (2013.01); *B65D 83/0835* (2013.01); *B65D 85/672* (2013.01); *A47K 2010/3233* (2013.01); *A47K 2010/3266* (2013.01); *B65D 2583/082* (2013.01)

(58) Field of Classification Search
CPC ..... A47K 10/38; B65D 83/0835
USPC ..... 221/33–63
See application file for complete search history.

(56) References Cited

U.S. PATENT DOCUMENTS

| | | | | |
|---|---|---|---|---|
| 6,364,101 | B1 | 4/2002 | Schultz | |
| 6,554,156 | B1 | 4/2003 | Chong | |
| 7,255,254 | B2 | 8/2007 | Tan | |
| 9,220,379 | B2 | 12/2015 | Winestock et al. | |
| 9,538,885 | B2 | 1/2017 | Cojocaru et al. | |
| 10,117,549 | B2 | 11/2018 | Atalla | |
| 2005/0029280 | A1* | 2/2005 | Hayes | B65D 83/0805 221/34 |
| 2005/0205594 | A1 | 9/2005 | Evans et al. | |
| 2009/0194553 | A1 | 8/2009 | Hoefing et al. | |
| 2009/0194554 | A1 | 8/2009 | Bliss et al. | |
| 2009/0194555 | A1 | 8/2009 | Hoefing et al. | |
| 2012/0118905 | A1 | 5/2012 | Lindbergh | |
| 2012/0145737 | A1* | 6/2012 | Ray | B65D 83/0805 221/45 |
| 2013/0116818 | A1* | 5/2013 | Hamilton | A61J 7/04 700/236 |
| 2015/0021349 | A1* | 1/2015 | Sanders | B65D 83/0409 221/1 |

FOREIGN PATENT DOCUMENTS

| | | |
|---|---|---|
| GB | 2394219 B | 10/2002 |

* cited by examiner

*Primary Examiner* — Gene O Crawford
*Assistant Examiner* — Ayodeji T Ojofeitimi
(74) *Attorney, Agent, or Firm* — Christensen O'Connor Johnson Kindness PLLC

(57) ABSTRACT

A wipes pack comprises a barrel having a central axis extending the length of the barrel, the barrel having an open top and a closed bottom; and a cap having a central axis extending the length of the cap, the cap has an open bottom and a closed top, wherein the cap is configured to fit within the open top of the barrel, the cap is lowered in the barrel to conceal a sidewall of the cap, and the cap is raised to expose the sidewall of the cap, wherein the sidewall of the cap includes a dispensing orifice; and the wipes pack includes a spindle that extends along the central axis of the cap or barrel or both, wherein the spindle is configured to support a roll aligned with the central axes of the cap or barrel or both.

20 Claims, 5 Drawing Sheets

REFILLABLE CYLINDRICAL COSMETIC WIPE DISPENSING SYSTEM

SUMMARY

In an embodiment, a wipes pack is refillable and is able to be easily cleaned and re-used.

In an embodiment, a wipes pack is aesthetically unique as a cosmetic or makeup remover pack as opposed to sachets that are similar to baby wipes.

In an embodiment, a wipes pack is quick to dispense wipes for use.

In an embodiment, the wipes pack can be used for a variety of wipe technologies, including conventional wet wipes, dry wipes, and dissolvable wipes.

In an embodiment, a wipes pack is capable of separating or tearing frangible wipes from a roll.

In an embodiment, a wipes pack is portable.

In an embodiment, a wipes pack uses a robust sealing system that prevents leaks and keeps wipes fresh.

In an embodiment, a wipes pack can be made from plastics for wet wipes or the same design can be made from paper for dry wipes.

In an embodiment, the wipes pack can be made from a lightweight material package, for example, a cap and barrel would both be either polypropylene or polyethylene.

In an embodiment, the wipes pack utilizes a cylindrical form, like a "barrel pack" for cleansing wipes, and has and effective seal and is aesthetically pleasing.

In an embodiment, the wipes pack seals effectively due to an annular sealing system against a cylindrical profile with can last many uses.

In an embodiment, the wipes pack uses rolled wipes as re-fills. No tube in the roll of wipes means that when the wipes are finished, there is no remaining waste.

In an embodiment, the wipes have an integrated wipe tearing system that separates frangible wipes and prepares the start of the next wipe for removal.

In an embodiment, the shape and configuration of the wipes pack also allows for a "hybrid" use of the wipe pack with dry wipes.

In an embodiment, the wipes pack is loaded with a roll of dry wipes as a refill, a user fills the plastic barrel with water, micellar water, etc. to create wet wipes. This allows the user to select the micellar water.

In an embodiment, the user creates their own wet wipes to meet the user's needs by selecting the formulation to add in the pack. A user can create different wipes, such as, make-up remover wipes, general cleaning wipes, and baby wipes, for example.

In an embodiment, a small form factor pack allows for high volumes of refills to be exchanged.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and advantages of the inventive technology will become more readily appreciated as the same become better understood by reference to the following detailed description, when taken in conjunction with the accompanying drawings, wherein.

DETAILED DESCRIPTION

Conventional wipes are dispensed from a sachet consisting of films of co-extruded plastics that form a good chemical and protective barrier, but the use of multiple films and the material of the barrier is not recyclable or sustainable.

In an embodiment, a wipes pack is cylindrical to allow a strong sealing configuration, is highly re-useable, portable, and the components can be produced from a single plastic polymer (i.e., monomaterial). This means that the wipes pack can be recycled conventionally at the end of its product life (separate from the wipes).

This configuration allows the pack to hold other saturated or dry non-woven or application wipes products, such as face or skin masks, pads, gauze, foam or cotton balls, and the like.

This pack can be used not only for cosmetic wipes, for example, but can also be adapted to use as a pack for any wipe product, such as baby wipes, sanitary wipes, cleansing wipes.

Figure 1:
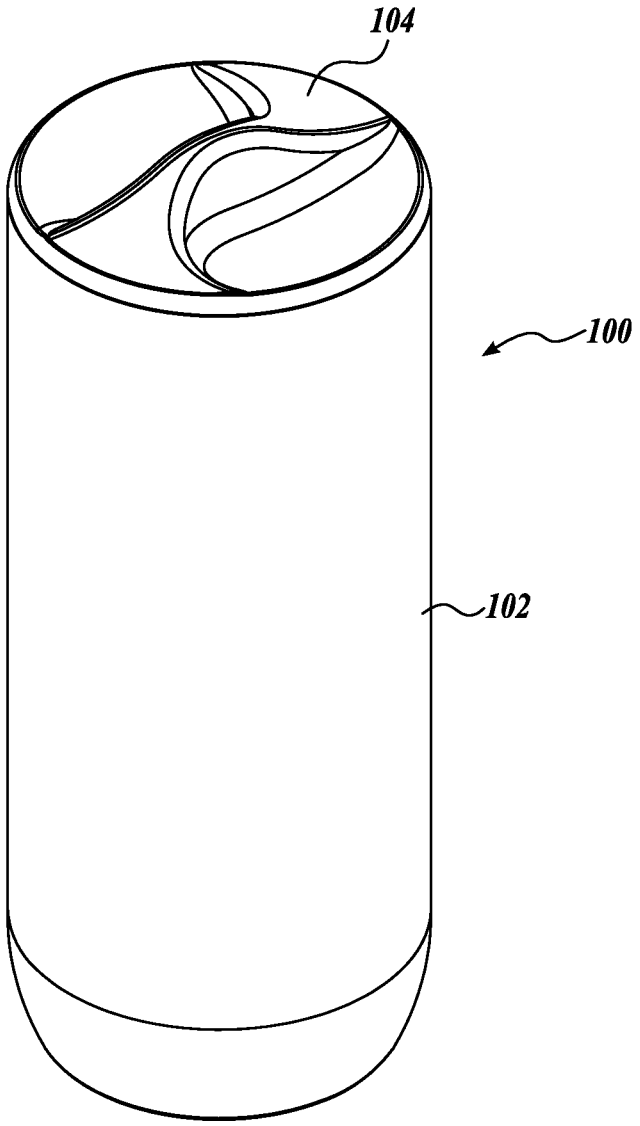
FIG. 1 is a diagrammatical illustration of a wipes pack according to an embodiment.

FIG. 1 is a diagrammatical illustration of a wipes pack 100 according to one embodiment of the present disclosure. In an embodiment, the wipes pack 100 has a cylindrical form. In an embodiment, the wipes pack 100 can have a cuboid shape, or any other shape or combination of shapes.

FIG. 1 is an illustration of an embodiment of a wipes pack 100 in accordance with an embodiment of this disclosure. The wipes pack 100 includes a barrel 102 and cap 104. In an embodiment, the barrel is an elongated cylindrical shape having a closed bottom and an open top. The cap 104 fits into the open top of the barrel 102. The cap 104 can be raised to expose a wipe dispenser orifice 108. After extracting the wipe, the cap 104 can be lowered back into the barrel 102. Further, the cap 104 can be removed entirely from the barrel 102 to re-fill the wipes pack 100. Therefore, the user can not only re-fill the pack with the same wipes multiple times, the user can select different types of wipes to use in the pack, and the user can select different formulations to impregnate the wipes based on the needs of the user.

In an embodiment, the barrel 102 and cap 104 can have any geometric form including regular or irregular forms. In an embodiment, the barrel 102 and cap 104 comprise a cross-section of substantially any geometric shape including circular, triangular, square, rectangular polygonal, regular or irregular shapes, or the like, as well as other symmetrical and asymmetrical shapes, or combinations thereof. In an embodiment, the barrel 102 and cap 104 include a body structure that is substantially cylindrical. In an embodiment, the barrel 102 and cap 104 include a body structure that is substantially rigid or semi-rigid. In an embodiment, the barrel 102 and cap 104 include a body structure that is pliable or semi-pliable. The barrel 102 and cap 104 can be constructed out of a variety of materials including, for example, elastomers, co-elastomers, polymers, co-polymers, and blends or combinations thereof, etc. Other suitable materials for fabrication of the barrel 102 and cap 104 include thermoplastic polymers, thermoplastic elastomers, glass, metals, carboard, pulp and paper, and the like. In an embodiment, the barrel 102 and cap 104 are made from the same material, such as polypropylene or polyethylene, and can be recycled.

In an embodiment, the barrel 102 and cap 104 are made from one or more recyclable materials, compostable materials, sustainable materials, biodegradable materials, plant-based material, and the like. In an embodiment, the barrel 102 and cap 104 comprise one or more of biodegradable polymers, biodegradable polyesters, biodegradable polyurethanes, biodegradable starches, biodegradable cellulosic materials, biodegradable aliphatic polyesters, and the like.

In an embodiment, the barrel and 102, 104 are made from injection molded starch. In an embodiment, the barrel 102 and cap 104 are made from bamboo or wood pulp or bagasse using thermoforming or injection molding processes. In an embodiment, the barrel 102 and cap 104 include mycelium and agricultural waste (as binder). In an embodiment, the barrel 102 and cap 104 are made bio-based thin films. In an embodiment, the barrel 102 and cap 104 are made from compostable or biodegradable materials, such as poly(lactic acid), polyethylene terephthalate, polycaprolactone, poly(1, 4-butylene succinate), polyhydroxyalkanoate, cellulose and its derivatives, and polybutylene adipate terephthalate. In an embodiment, the barrel 102 and cap 104 are made from non-woven poly(vinyl alcohol), optionally, impregnated with active ingredients.

Figure 2:
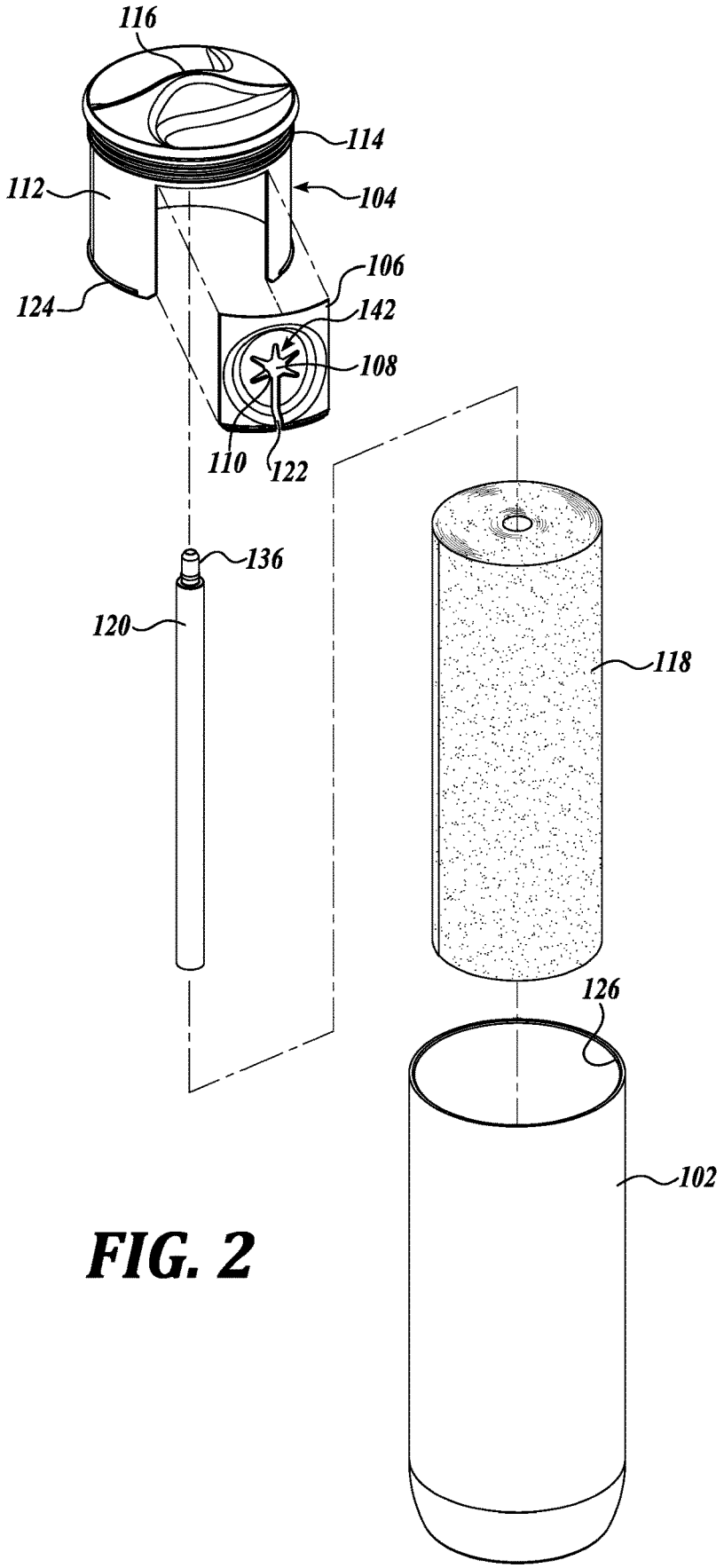
FIG. 2 is a diagrammatical illustration of an exploded view of the wipes pack of FIG. 1.
Figure 3:
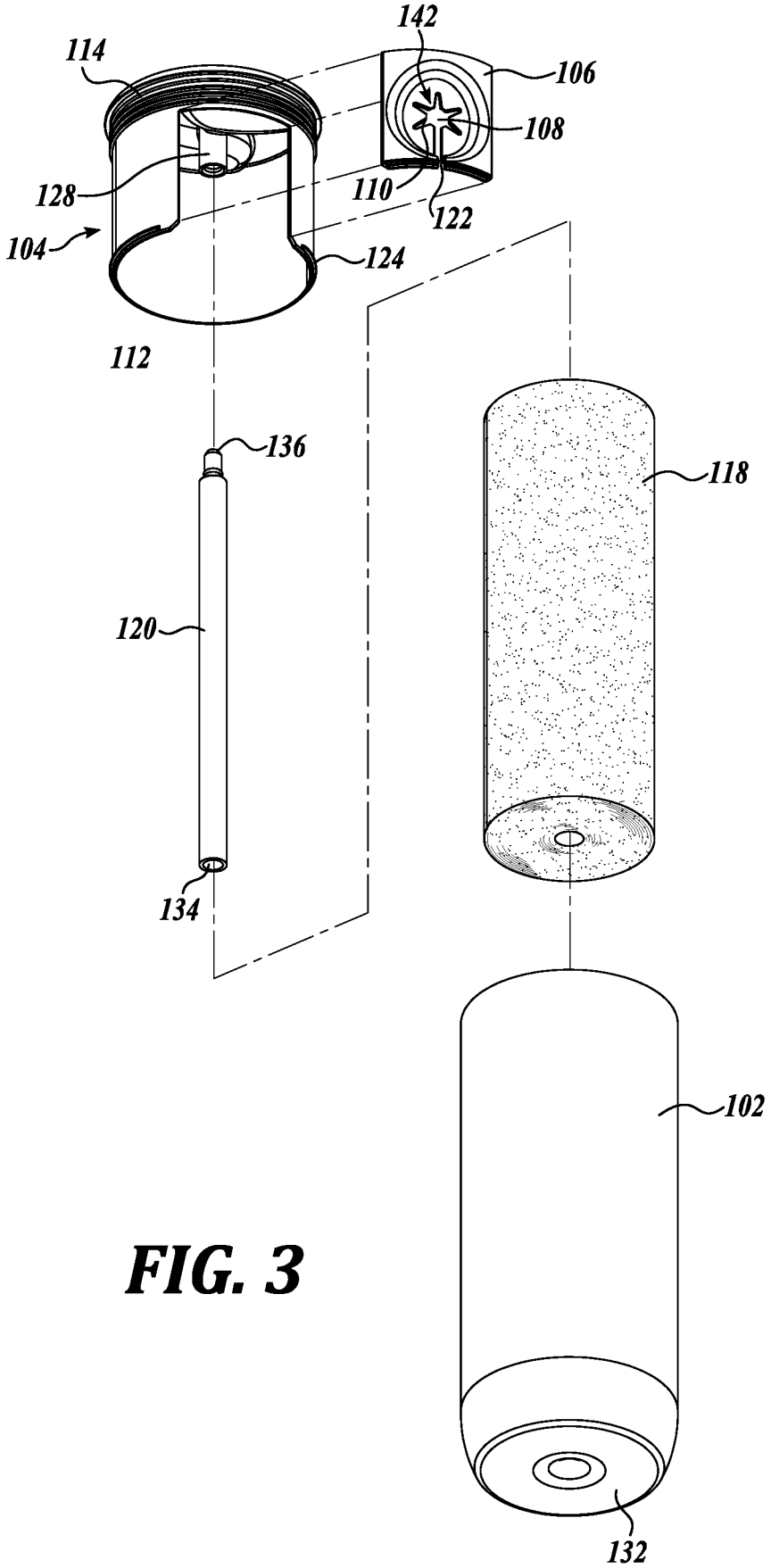
FIG. 3 is a diagrammatical illustration of an exploded view of the wipes pack of FIG. 1.
Figure 4:
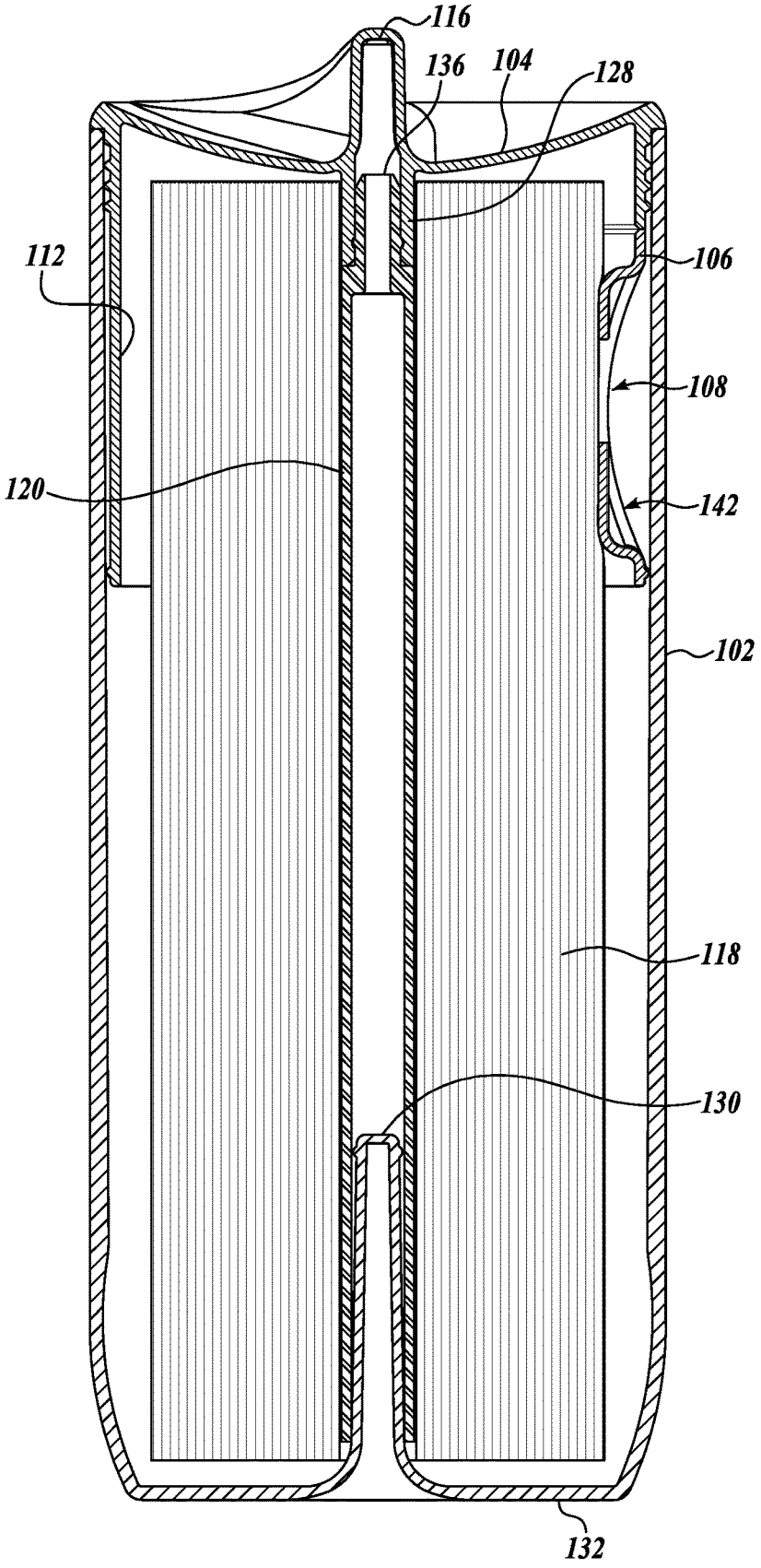
FIG. 4 is a diagrammatical illustration of a cross-sectional view of the wipes pack of FIG. 1.

Referring to FIGS. 2, 3, and 4, an embodiment of the wipes pack 100 will be described. In an embodiment, the wipes pack 100 comprises a barrel 102 having a central axis extending the length of the barrel, the barrel has an open top and a closed bottom, and a cap 104 having a central axis extending the length of the cap, the cap has an open bottom and a closed top, wherein the cap is configured to fit within the open top of the barrel. In an embodiment the cap 104 is lowered in the barrel 102 to conceal a sidewall 112 of the cap 104, and the cap 104 is raised to expose the sidewall 112 of the cap 104, wherein the sidewall 112 of the cap includes a dispensing orifice 108. In an embodiment, the wipes pack 100 includes a spindle 120, 128, or 130 that extends along the central axis of the cap 104 or barrel 102 or both, wherein the spindle 120, 128, or 130 is configured to support a roll 118 aligned with the central axes of the cap 104 or barrel 102 or both.

In an embodiment, the barrel 102 is a cylindrical body that is closed on the bottom and open on top, wherein the length of the cylindrical body is greater than the diameter of the cylindrical body. With reference to FIG. 4, the bottom 132 of the cylindrical body is formed from an annular flat surface whose outer diameter connects to the upright cylindrical walls of the barrel 102, and the inner diameter of the annular bottom 132 connects to an upright rod or tube 130 extending upward from the center of the annular surface in the same direction as the walls and can be aligned with the central axis of the barrel 102.

In an embodiment, the tube 130 can support an optional spindle 120, or in an embodiment, the spindle 120 is not used, and the tube 130 can function as the spindle by extending the length of the tube 130.

In an embodiment, the spindle 120 is an elongated tube or rod of generally constant diameter having an opening 134 at the bottom end and a stub 136 formed by reducing the diameter on the top end. The opening 134 receives the tube 130 and the stub 136 is inserted into a tube 128 projecting downward from the underside of the cap 104. Accordingly, the spindle 120 is held upright secured to the barrel 102 and cap 104 and can be aligned with the central axes of both the cap 104 and barrel 102. In an embodiment, the spindle 120 is optional, and the tube 128 projecting downward from the underside of the cap 104 functions as a spindle for the roll 118, provided that the tube 128 is extended a sufficient length.

In an embodiment, the spindle 120 (or tube 128 or tube 130) outer diameter will need to be smaller than the inside diameter of a roll 118 of wipes to allow the roll 118 to be held on the spindle 120 and allow either the roll 118 to rotate on the spindle 120, or the spindle 120 can rotate together with the roll 118, or a combination of both. In an embodiment, a re-useable spindle 120 avoids having a hard tube at the center in the wipes roll 118. However, in an embodiment, the roll 118 can be provided with a hard tube at the center.

In an embodiment, the roll 118 is replaceable with another roll having the same or a different kind of wipes. The roll 118 can include wipes to be used for any purpose. In an embodiment, wipes can be for general sanitizing or cleansing. In an embodiment, wipes can have a specific purpose, such as make-up remover wipes, baby wipes, stainless steel cleaner wipes, and the like.

In an embodiment, the wipes can be pre-moistened with a formulation. In an embodiment, the wipes are dry wipes, for example, facial and nose tissues. In an embodiment, the wipes can be dry wipes upon loading into the pack 100, and the user can fill the barrel 102 with regular tap water, or micellar water. In an embodiment, dry wipes can be impregnated with a dry formulation when used to re-fill the pack 100, and the wipes can be used as dry wipes, or the wipes can first be impregnated with a liquid formulation. In an embodiment, the re-fill wipes do not come with a pre-impregnated formulation, and the user can select the formulation to use with the wipes depending on the needs of the user. For example, the user can purchase a formulation used for general cleaning or sanitizing, a formulation used for make-up removal, a formulation used for hand wipes, a formulation used for baby wipes, and the like. The user can re-fill the pack 100 with dry wipes and separately select the formulation.

In an embodiment, wipes are connected to each other and utilize a tearing system to separate wipes from each other. For example, juxtaposed wipes on the roll 118 can be connected to each other by perforations to enable tearing one wipe from the next. Juxtaposed wipes on the roll 118 can be packaged so as to not need to be torn from each other. For example, individual wipes can also be overlapped with each other sufficiently so as to draw out the next wipe when pulling one wipe through the dispensing orifice 108.

In an embodiment, the dispensing orifice 108 from which a user draws out the wipes has features to further facilitate the separation of one wipe from the next wipe. In an embodiment, the dispensing orifice 108 is surrounded by centrally inwardly projecting barbs 110, arranged like a star shape around the dispensing orifice 108, to catch or snag the wipe to allow applying force to enable to tear or separate one wipe from the next wipe. Barbs 110 are spaced circularly around the dispensing orifice 108, such that adjacent barbs 110 are separated by notches. In an embodiment, the barbs 110 are flexible, for example, to allow pulling a wipe generally linearly straight out from the dispensing orifice 108, and once past the end of the wipe, the pulling angle is severely increased, so that the next wipe catches on the barbs 110 and the pulling force tears the first wipe from the wipe that catches on the barbs 110.

In an embodiment, the dispensing orifice 108 also has a starting slot 122 to allow feeding the first wipe on the roll 118 through the slot 122 into the dispensing orifice 108. The starting slot 122 extends from the bottom edge of cap 104 or a snap-on dispenser 106 and leads to the dispensing orifice 108.

The cap 104 includes a closed top and an open bottom. The cap 104 includes a cylindrical wall 112 that extends down from the closed top. The cylindrical wall 112 extends less than the full 360 degrees around the circumference of cap 104. In an embodiment, the cylindrical wall 112 may extend for about 300 degrees or more or less of the cap circumference, for example, and the remaining circumference is filled by the snap-on dispenser 106 having the wipe dispensing orifice 108. In an embodiment, the dispensing orifice 108 is disposed on the side (i.e., radially) with respect to the barrel 102 and cap 104 by being disposed on the sidewall 112 or on a dedicated snap-on dispenser 106.

In an embodiment, the snap-on dispenser 106 is a generally square shape or a shape to match the missing part of the cylindrical sidewall 112 with a matching radius curve. In an embodiment, the snap-on dispenser 106 has a circular inwardly recessed section 142 defining the center of the snap-on dispenser 106. In an embodiment, the dispensing orifice 108 is formed in the inwardly recessed section 142 of the snap-on dispenser 106. In an embodiment, the snap-on dispenser 106 can be secured to the cap 104 by forming channels on the vertical and top edges of the snap-on dispenser 106, and then fitting the channels to the exposed vertical and top edge of the cylindrical wall 112.

In an embodiment, the snap-on dispenser 106 may be made from more flexible, elastic material as compared to the remainder of the cap 104 and cylindrical wall 112. In an embodiment, the cylindrical wall 112 can extend 360 degrees around the cap 104, and a wipe dispensing orifice is formed or cut from the cylindrical wall 112, thereby, eliminating the need for a snap-on dispenser 106.

In an embodiment, the exterior top edge of the cylindrical wall 112 of the cap 104 includes a sealing system. In an embodiment, only a single sealing system is required to seal the cap 104 to the barrel 102. In one embodiment, the sealing system include one or more sealing rings 114. In an embodiment, sealing rings 114 are integral and monolithic with the cap 104. In an embodiment, sealing rings 114 are separate and a different material from the cap 104. In an embodiment, sealing rings 114 are made of elastic materials. Sealing rings 114 may set into grooves in the cap 104. Sealing rings 114 have an outer diameter to match the inside diameter of the barrel 102. In an embodiment, sealing rings may also be provided on the barrel 102 in addition to or as an alternative to the sealing rings 114 on the cap 104. The sealing rings 112 can provide a robust sealing system that prevents leaks and keeps the wipes in a fresh moistened condition for longer periods. In an embodiment, the annular sealing system is an effective seal for a cylindrical profile after many uses of the wipes pack.

Referring to FIG. 4, in an embodiment, the top of the cap 104 is closed. The top of the cap 104 may further include a handle 116 of any shape or style designed to enable manually grasping the handle 116 to lift the cap 104 from the barrel 102 and push the cap 104 back within the barrel 102. In an embodiment, the cap 104 is wholly removable from the barrel 102 to re-fill the barrel 102 with a new roll 118 of wipes. For dispensing a wipe, the cap 104 is only raised to expose the dispensing orifice 108 to allow withdrawing the wipe.

Referring to FIG. 2, in an embodiment, the lower exterior periphery of the cylindrical wall 112 has an outwardly projecting lip 124, and the barrel 102 has an inwardly projecting lip 126 at the upper interior periphery of the barrel 102. Both the inward projecting lip 126 and the outward projecting lip 126 can be continuous, extending, for example, about the same circumference as the cylindrical wall 112. Therefore, when the cap 104 is raised up, the outward lip 124 on the cap 104 will stop on the inward projecting lip 126 on the barrel 102, thereby impeding further upward movement of the cap 104. In an embodiment, this impediment can be overcome by squeezing the cap 104 or barrel 102 to disengage the cap 104 from the barrel 104. Thereby, allowing a user to wholly remove the cap 104 from the barrel 102.

In another embodiment, instead of using continuous lips 124, 126, the lower periphery of the cylindrical wall 112 can be provided with a series of outward projecting notches and crenulations, and the upper periphery of the barrel 102 is also provided with a series of notches and crenulations to match with the notches and crenulations of the cap 104. In this way, the cap 104 is fitted on the barrel 102 by passing the cap crenulations through the barrel notches and then twisted to "lock" the cap 104. This configuration still allows the cap 104 to be raised without accidentally disengaging the cap 104 from the barrel 102, but also allows removing the cap 104 entirely from the barrel 102 when needed to re-fill the wipes.

Figure 5:
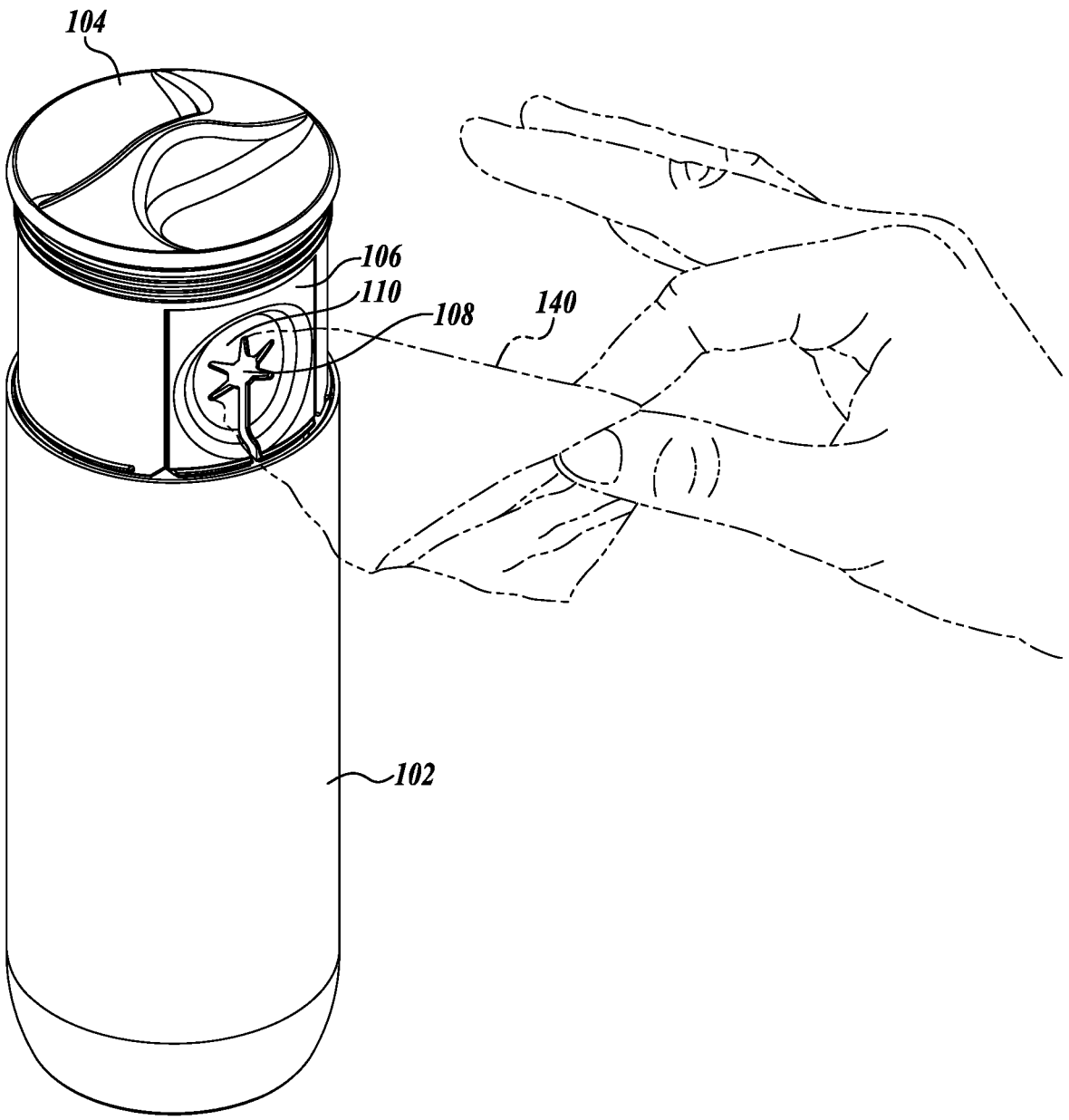
FIG. 5 is a diagrammatical illustration f a cross-sectional view of the wipes pack of FIG. 1.

FIG. 5 is an illustration showing the combination of the wipes pack 100 and a roll of wipes. A method of making a wipes pack 100 and wipes combination may include removing the cap 104 from the barrel 104. Then, placing the roll 118 of wipes with a center of the roll aligned with the central axes of the cap 104 or barrel 102. Then, passing a wipe 140 from the roll through the slot 122 leading to the dispensing orifice 118 in the cap 104. Then, placing the cap 104 on the barrel. In an embodiment, a user may use place dry wipes in the barrel 102, and then add a liquid formulation according to his/her choosing to moisten the wipes. In an embodiment, dry wipes can be impregnated with a dry formulation, and the wipes can be used as dry wipes, or the wipes can first be impregnated with a liquid formulation.

In FIG. 5, the cap 104 is shown in the raised dispensing position on the barrel 102. The dispensing orifice 108 is disposed radially (i.e., to the side) with respect to the barrel 102 and cap 104. In an embodiment, the wipes 104 are pulled off the roll 118 from the exterior of the roll 118, and not from the center of the roll. A wipe 140 can be pulled generally linearly straight out or at an angle from the dispensing orifice 108. At this point, the barbs 110 can flex outward to allow passage of the wipe 140 with minimal resistance at least below the tearing force needed to tear one wipe from the next. When the wipe 140 is past the tearing system, the angle of pulling can be altered severely to catch the next wipe in the barbs 110, the resistance increases at this point, and the wipe 140 can torn off from the next wipe. The cap 104 can be pushed back into the barrel 102 to maintain the freshness of the wipes owing to the sealing system.

In an embodiment, the dispensing orifice 108 is formed in an inwardly recessed section 142 of the snap-on dispenser 106 as shown in FIG. 5. This can allow the start of the next wipe to occupy the recessed section 142, and the barbs 110 prevent the wipe from falling out of the dispensing orifice 108, thus, allowing the cap 140 to seal properly to the barrel 102, without the wipe interfering with the sealing rings 114 and having the wipe ready for the next use.

According to the disclosure representative embodiments include, but are not limited to the following.

In an embodiment, a wipes pack 100 comprises a barrel 102 having a central axis extending the length of the barrel, the barrel having an open top and a closed bottom; and a cap 104 having a central axis extending the length of the cap, the cap has an open bottom and a closed top, wherein the cap is configured to fit within the open top of the barrel, the cap is lowered in the barrel to conceal a sidewall 112 of the cap, and the cap is raised to expose the sidewall of the cap, wherein the sidewall of the cap includes a dispensing orifice 108; and the wipes pack includes a spindle 120, 128, or 130 that extends along the central axis of the cap or barrel or both, wherein the spindle is configured to support a roll 118 aligned with the central axes of the cap or barrel or both.

In an embodiment, the wipes pack further comprises a single sealing system 114 between the cap and barrel.

In an embodiment, the single sealing system is configured to seal between the upper peripheral edge of the cap and the upper peripheral edge of the barrel.

In an embodiment, the single sealing system comprises one or more sealing rings 114 around an upper exterior peripheral edge of the cap.

In an embodiment, the wipes pack comprises an outwardly projecting lip 124 on the exterior periphery of the bottom edge of the cap and an inwardly projecting lip 126 on the interior periphery of the top edge of the barrel.

In an embodiment, the dispensing orifice is surrounded by centrally inwardly projecting barbs 110.

In an embodiment, a slot 122 extends from a bottom edge of the cap to the dispensing orifice.

In an embodiment, the spindle includes a tube 130 extending up from a bottom of the barrel, or a tube 128 extending down from a top of the cap, or a tube 120 connected between the bottom of the barrel to the top of the cap.

In an embodiment, the dispensing orifice is within an inwardly recessed section 142 on the sidewall of the cap.

In an embodiment, the wipes pack comprises a flexible snap-on dispenser 106 having the dispensing orifice, wherein the snap-on dispenser is connected to the sidewall 112 of the cap.

In an embodiment, the cap is removable from the barrel.

In an embodiment, a wipes pack and wipes combination comprises a wipes pack 100 including a barrel 102 having a central axis extending the length of the barrel, the barrel having an open top and a closed bottom; and a cap 104 having a central axis extending the length of the cap, the cap has an open bottom and a closed top, wherein the cap is configured to fit within the open top of the barrel, the cap is lowered in the barrel to conceal a sidewall 112 of the cap, and the cap is raised to expose the sidewall of the cap, wherein the sidewall of the cap includes a dispensing orifice 108; and the wipes pack includes a spindle 120, 128, or 130 that extends along the central axis of the cap or barrel or both, wherein the spindle is configured to support a roll 118 aligned with the central axes of the cap or barrel or both; and a roll of wipes on the spindle, wherein the center of the roll is aligned with the central axes of the cap or barrel or both.

In an embodiment, the wipes pack and wipes combination includes wipes 140 that are dry wipes or pre-moistened wipes.

In an embodiment, the wipes pack and wipes combination includes a roll 118 of wipes that does not have a tube in the center.

In an embodiment, a method of making a wipes pack and wipes combination comprises removing the cap 104 from the barrel 104 and placing the roll 118 of wipes with a center of the roll aligned with the central axes of the cap or barrel or both. Then, placing the cap on the barrel.

In an embodiment, the method of making comprises passing a wipe 140 from the roll through a slot 122 leading to the dispensing orifice 108 and then passing the wipe through the dispensing orifice.

In an embodiment, the method of making comprises adding water or micellar water or any formulation selected by the user to the barrel.

In an embodiment, a method for dispensing a wipe comprises raising the cap 104 from the barrel 104 of the wipes pack and wipes combination, pulling a wipe 140 from the dispensing orifice 108 on the sidewall 118 of the cap and tearing the wipe from an adjacent wipe, and lowering the cap into the barrel after tearing the wipe.

In an embodiment, the method of dispensing includes a roll of wipes that rotates around a central axis of the cap or barrel or both.

In an embodiment, the method of dispensing comprises engaging a sealing system 114 between the cap and barrel when lowering the cap into the barrel.

From the foregoing, it will be appreciated that specific embodiments of the technology have been described herein for purposes of illustration, but that various modifications may be made without deviating from the disclosure. Moreover, while various advantages and features associated with certain embodiments have been described above in the context of those embodiments, other embodiments may also exhibit such advantages and/or features, and not all embodiments need necessarily exhibit such advantages and/or features to fall within the scope of the technology. Where methods are described, the methods may include more, fewer, or other steps. Additionally, steps may be performed in any suitable order. Accordingly, the disclosure can encompass other embodiments not expressly shown or described herein.

While several embodiments have been illustrated and described, it will be appreciated that various changes can be made therein without departing from the spirit and scope of the inventive technology.

The embodiments of the invention in which an exclusive property or privilege is claimed are defined as follows:

1. A wipes pack, comprising:

a barrel having a central axis extending the length of the barrel, the barrel having an open top and a closed bottom; and a cap having a central axis extending the length of the cap, the cap has an open bottom and a closed top, wherein the cap is configured to fit within the open top of the barrel, the cap is lowered in the barrel to conceal a dispensing orifice in the sidewall of the cap, and the cap is raised to expose the dispensing orifice in the sidewall of the cap; and a spindle extends along the central axis of the cap or barrel or both, wherein the spindle is configured to support a roll aligned with the central axes of the cap or barrel or both.

2. The wipes pack of claim 1, comprising an outwardly projecting lip on the exterior periphery of the bottom edge of the cap and an inwardly projecting lip on the interior periphery of the top edge of the barrel.

3. The wipes pack of claim 1, wherein the dispensing orifice is surrounded by centrally inwardly projecting barbs.

4. The wipes pack of claim 1, wherein a slot extends from a bottom edge of the cap to the dispensing orifice.

5. The wipes pack of claim 1, wherein the spindle includes a tube extending up from a bottom of the barrel, or a tube extending down from a top of the cap, or a tube connected between the bottom of the barrel to the top of the cap.

6. The wipes pack of claim 1, wherein the dispensing orifice is within an inwardly recessed section on the sidewall of the cap.

7. The wipes pack of claim 1, comprising a flexible snap-on dispenser having the dispensing orifice, wherein the snap-on dispenser is connected to the sidewall of the cap.

8. The wipes pack of claim 1, wherein the cap is removable from the barrel.

9. The wipes pack of claim 1, further comprising a single sealing system between the cap and barrel.

10. The wipes pack of claim 9, wherein the single sealing system is configured to seal between the upper peripheral edge of the cap and the upper peripheral edge of the barrel.

11. The wipes pack of claim 9, wherein the single sealing system comprises one or more sealing rings around an upper exterior peripheral edge of the cap.

12. A wipes pack and wipes combination, comprising;

the wipes pack of claim 1; and a roll of wipes on the spindle, wherein the center of the roll is aligned with the central axes of the cap or barrel or both.

13. The wipes pack and wipes combination of claim 12, wherein the wipes are dry wipes or pre-moistened wipes.

14. The wipes pack and wipes combination of claim 12, wherein the roll of wipes does not have a tube in the center.

15. A method of making a wipes pack and wipes combination of claim 12, comprising;

removing the cap from the barrel;

placing the roll of wipes with a center of the roll aligned with the central axes of the cap or barrel or both; and placing the cap on the barrel.

16. The method of claim 15, comprising passing a wipe from the roll through a slot leading to the dispensing orifice and then passing the wipe through the dispensing orifice.

17. The method of claim 15, comprising adding water or micellar water or a formulation to the barrel.

18. A method for dispensing a wipe, comprising:

the raising the cap from the barrel of the wipes pack and wipes combination of claim 12;

pulling a wipe from the dispensing orifice on the sidewall of the cap and tearing the wipe from an adjacent wipe; and lowering the cap into the barrel after tearing the wipe.

19. The method of claim 18, wherein the roll of wipes rotates around a central axis of the cap or barrel or both.

20. The method of claim 18, comprising engaging a sealing system between the cap and barrel when lowering the cap into the barrel.

* * * * *